US008161959B1

(12) United States Patent
O'Reilly

(10) Patent No.: US 8,161,959 B1
(45) Date of Patent: Apr. 24, 2012

(54) WOOD BURNING FURNACE

(76) Inventor: Paul D. O'Reilly, Oxford, MA (US)

( * ) Notice: Subject to any disclaimer, the term of this patent is extended or adjusted under 35 U.S.C. 154(b) by 45 days.

(21) Appl. No.: 12/657,053

(22) Filed: Jan. 12, 2010

(51) Int. Cl.
*F24B 5/00* (2006.01)

(52) U.S. Cl. ..... 126/76; 126/58; 126/66; 126/67; 126/77; 126/112; 110/211; 110/214

(58) Field of Classification Search ..... 126/76, 126/58, 66, 67, 77, 112; 110/211, 214
See application file for complete search history.

(56) References Cited

U.S. PATENT DOCUMENTS

| | | | | |
|---|---|---|---|---|
| 4,559 | A | | 6/1846 | Slades |
| 38,828 | A | | 6/1863 | Hunt |
| 89,141 | A | | 4/1869 | Goodfellow |
| 204,406 | A | | 5/1878 | White |
| 327,650 | A | | 10/1885 | Boyd |
| 548,079 | A | | 10/1895 | Miller |
| 552,911 | A | | 1/1896 | Knauss |
| RE11,623 | E | | 7/1897 | McLean |
| 713,066 | A | | 11/1902 | Cooper |
| 719,827 | A | | 2/1903 | Matthews |
| 801,723 | A | | 10/1905 | Lange |
| 843,103 | A | | 2/1907 | Roell |
| 1,044,724 | A | | 11/1912 | Atteberry |
| 1,954,923 | A | | 4/1934 | Eichhorn |
| 2,227,689 | A | | 1/1941 | Agricola |
| 2,352,057 | A | | 6/1944 | Wingert |
| 2,454,044 | A | | 11/1948 | Eggert |
| 2,461,068 | A | | 2/1949 | Lockwood |
| 2,469,639 | A | | 5/1949 | Franklin |
| 2,564,713 | A | | 8/1951 | Miles |
| 2,607,335 | A | | 8/1952 | Harding |
| 2,797,874 | A | | 7/1957 | Harding |
| 3,168,088 | A | | 2/1965 | Martin et al. |
| 3,765,823 | A | | 10/1973 | Kawabata et al. |
| 4,047,515 | A | | 9/1977 | Daniel |
| 4,052,136 | A | | 10/1977 | Ulricksen |
| 4,154,212 | A | | 5/1979 | Wilkinson |
| 4,182,304 | A | | 1/1980 | Mele |
| 4,194,487 | A | | 3/1980 | Cadwallader et al. |
| 4,326,495 | A | | 4/1982 | Millar |
| 4,350,141 | A | | 9/1982 | Miller |
| 4,360,000 | A | | 11/1982 | Down |
| 4,362,146 | A | | 12/1982 | Schuller |
| 4,432,335 | A | | 2/1984 | Kilham |
| 4,434,782 | A | * | 3/1984 | Traeger ..... 126/77 |
| 4,466,358 | A | * | 8/1984 | Christian ..... 110/211 |
| 4,484,530 | A | | 11/1984 | Goetzman |
| 4,510,917 | A | | 4/1985 | Runquist |
| 4,630,553 | A | | 12/1986 | Goetzman |
| 4,635,899 | A | | 1/1987 | Eshleman |
| 4,677,965 | A | | 7/1987 | Duerichen |
| 4,856,491 | A | | 8/1989 | Ferguson et al. |
| 5,462,043 | A | | 10/1995 | Rose et al. |
| 5,983,885 | A | | 11/1999 | Jarvi |

(Continued)

*Primary Examiner* — Steven B McAllister
*Assistant Examiner* — Avinash Savani
(74) *Attorney, Agent, or Firm* — John P. McGonagle

(57) ABSTRACT

A wood burning furnace providing, in sequential connection, an air box, a fire box with a wood storage box/primary combustion chamber and a secondary combustion chamber separated by an ash grate, a heat exchanger, an exhaust manifold, and a smoke stack. The air box has an input port attached to an intake air blower. The air box also has two dampers, a thermostatically controlled first damper providing controlled access to an updraft exhaust pipe connected to the smoke stack. The second damper provides controlled access to the wood storage box/primary combustion chamber.

7 Claims, 7 Drawing Sheets

U.S. PATENT DOCUMENTS

| | | | | |
|---|---|---|---|---|
| 6,213,116 | B1 | 4/2001 | Swainson | |
| 6,397,833 | B1 | 6/2002 | Jarvi | |
| 6,688,302 | B2 | 2/2004 | Henry et al. | |
| 6,817,354 | B2 * | 11/2004 | Laitinen | 126/77 |
| 7,066,170 | B1 | 6/2006 | Atemboski et al. | |
| 7,216,645 | B2 | 5/2007 | Henry et al. | |
| 7,325,541 | B2 | 2/2008 | Marcakis | |
| 2008/0035137 | A1 | 2/2008 | Federico | |
| 2008/0223266 | A1 | 9/2008 | Brazier et al. | |

* cited by examiner

WOOD BURNING FURNACE

BACKGROUND OF THE INVENTION

This invention relates to furnaces, and more particularly to wood-burning, downdraft furnace.

A simple wood-burning furnace usually comprises a metal box having a door for loading wood, an air inlet control system (often part of the door) for controlling the amount of combustion air admitted into the box and an exhaust flue for directing exhaust gases from the box. Such simple wood burning stoves tend to be inefficient because unburned vapors and particulates pass out of the exhaust flue. Admitting more combustion air may reduce the amount of unburned vapors and particulates passed out of the exhaust flue, but then the fire tends to burn too hot and too fast.

A solution to such problems is to make the wood-burning furnace a downdraft furnace. Downdraft furnaces promote "secondary combustion." Primary combustion is throttled by controlling the amount of combustion air. The unburned vapors and particulates are then mixed with heated air to burn such vapors and particulates and thereby recover more heat and reduce pollution.

"Downdraft" furnaces are known in the prior art. A downdraft furnace, also known as a "magazine" furnace, is comprised of an air supply, a wood storage section, a primary combustion chamber and ash grate, a secondary combustion chamber, a heat exchanger, an exhaust manifold, and an exhaust flue, i.e., smoke stack. Combustion is initiated at the top of the wood storage section flowing downward to the bottom of the wood storage in a primary combustion chamber. The wood combustion results in gasification of the wood fuel and combustion of the gas and residual particulates in a secondary combustion chamber resulting in a very high temperature combustion, i.e., typically 2000 degrees F. The heated air from combustion passes through the heat exchanger and exits the exhaust manifold to the smoke stack. In theory, downdraft furnaces should be able to provide complete combustion, however practical applications of the downdraft principles have resulted in incomplete combustion and poor heat transfer from fuels. The main problem arises from the difficulty of providing the proper amount of air to the combustion process of the furnace's fuel.

SUMMARY OF THE INVENTION

The present invention overcomes the limitations of prior art downdraft furnaces by providing a unique approach to providing the proper amount of air to the combustion process. The present invention provides in sequential connection an air box, a fire box with a wood storage box/primary combustion chamber and a secondary combustion chamber separated by an ash grate, a heat exchanger, an exhaust manifold, and a smoke stack. The air box has an input port attached to an intake air blower. The air box also has two dampers, a first damper (thermostatically controlled) providing controlled access to an updraft exhaust pipe connected to the smoke stack. The second damper provides controlled access to the wood storage box/primary combustion chamber. Air is brought into the air box and forced downwardly through the second damper through the wood storage box/primary combustion chamber containing a wood fire with a bed of coals being fed with fresh fuel from above. The fire releases smoke, particulates, combustibles and other volatile gases through the ash grate into the secondary combustion chamber. The wood combustion in the primary combustion chamber results in gasification of the wood fuel through the ash grate and combustion of the gas and residual particulates in a secondary combustion chamber resulting in a very high temperature combustion. The air provided for combustion of the starting fuel material is forced through the hot coals of the burned fuel, pulling vapors and particulates within the air to the secondary combustion chamber. Combustion of the particulates, gases and smoke continues within the secondary combustion chamber. Heated air from the secondary combustion chamber passes through the heat exchanger and exits through the manifold to the smoke stack. The air box first damper directs a portion or all of the air from the blower through the exhaust pipe through the manifold into the smoke stack, thereby providing a full or partial air bypass of the combustion chambers. Through manipulation of the blower and air box dampers specific control of the stove is attained.

The present invention is unique from prior art downdraft furnaces in that the present invention dampers are contained in a self-contained air box separated from and positioned above the furnace body. The invention air blower feeds directly into the air box and not the stove body. Thermostat control of the first damper is also provided. The air blower may be manually controlled or controlled with a thermostat.

These together with other objects of the invention, along with various features of novelty, which characterize the invention, are pointed out with particularity in the claims annexed hereto and forming a part of the disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF INVENTION

Figure 1:
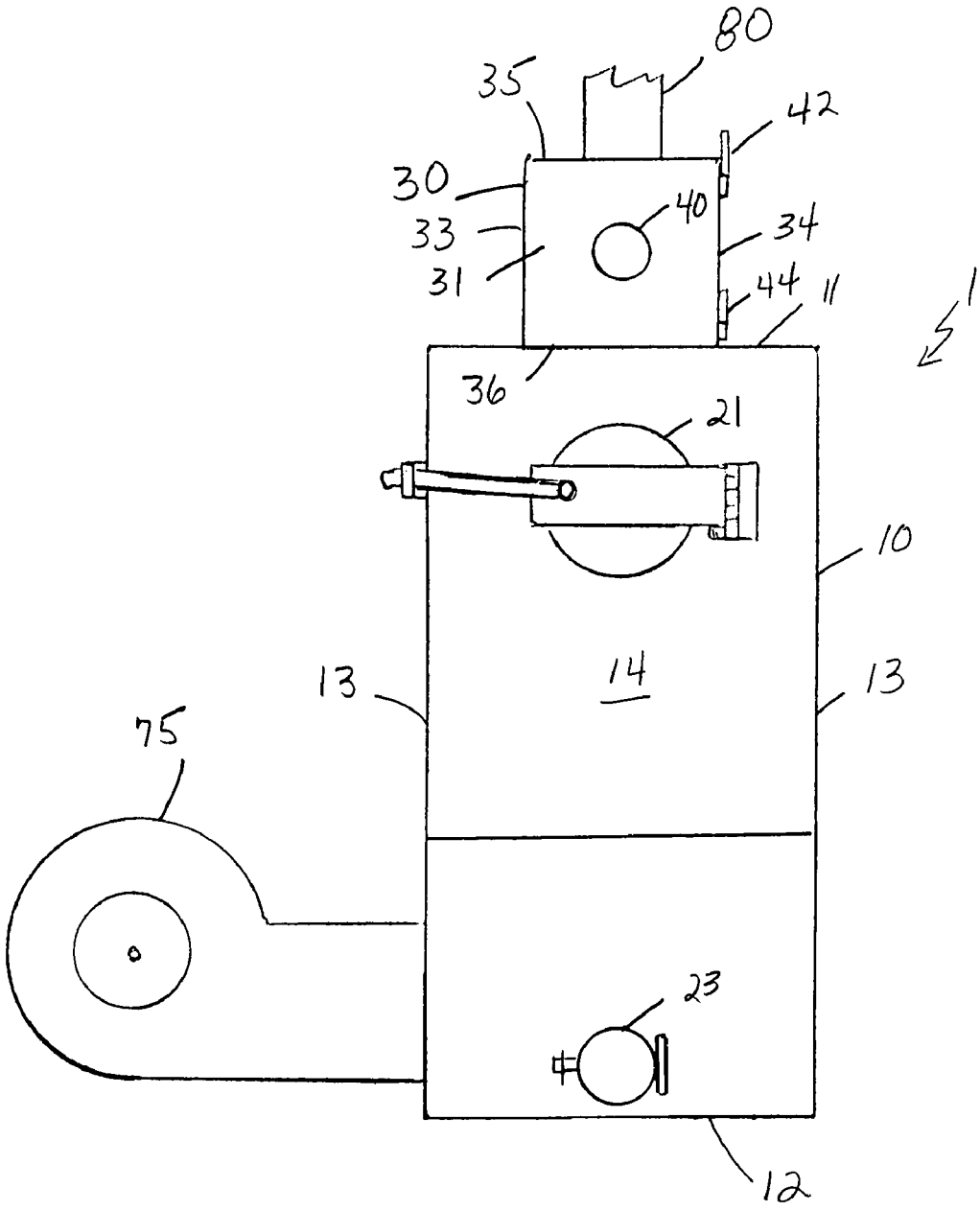
FIG. 1 is a front view of the invention furnace.
Figure 2:
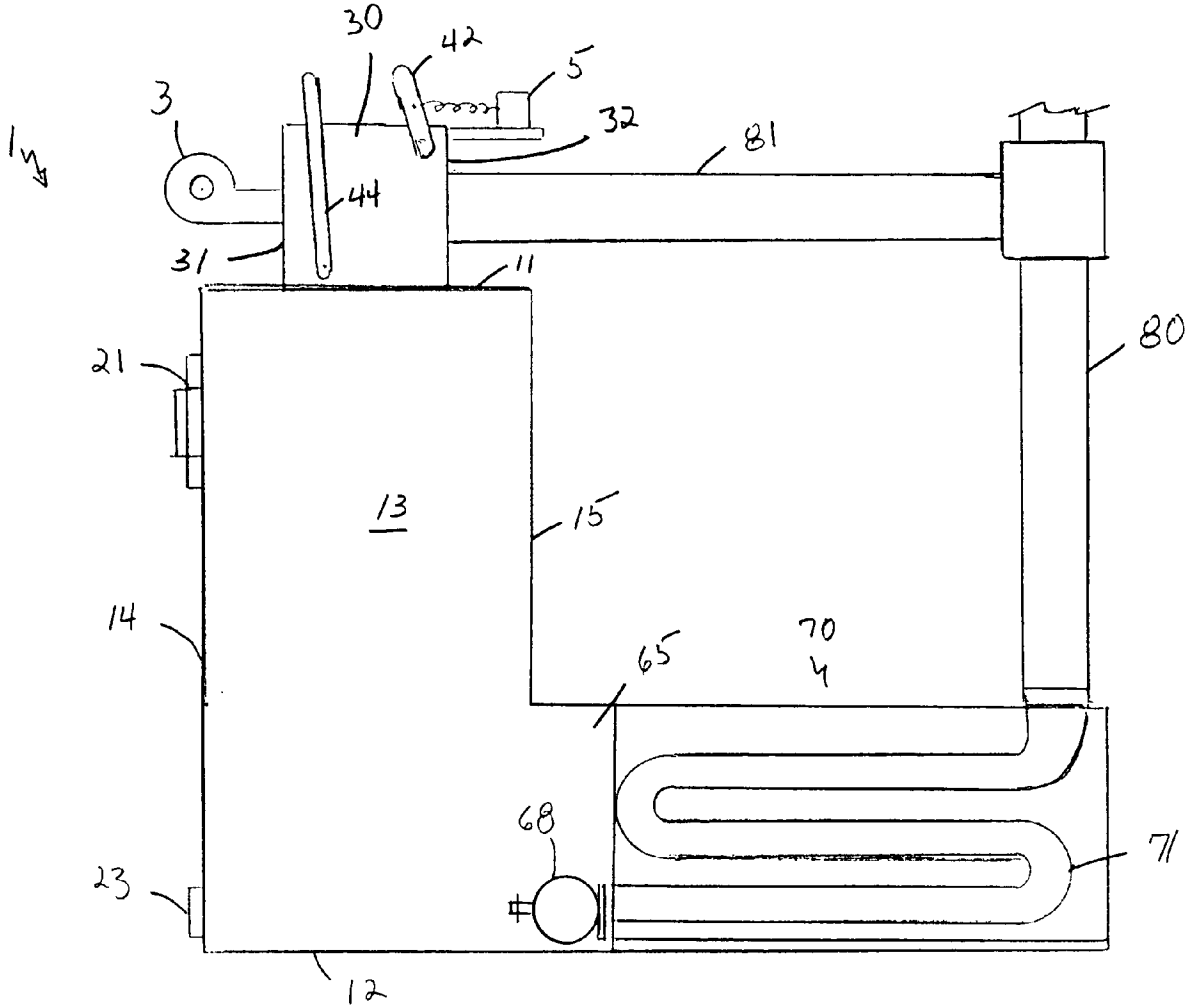
FIG. 2 is a side view thereof.
Figure 3:
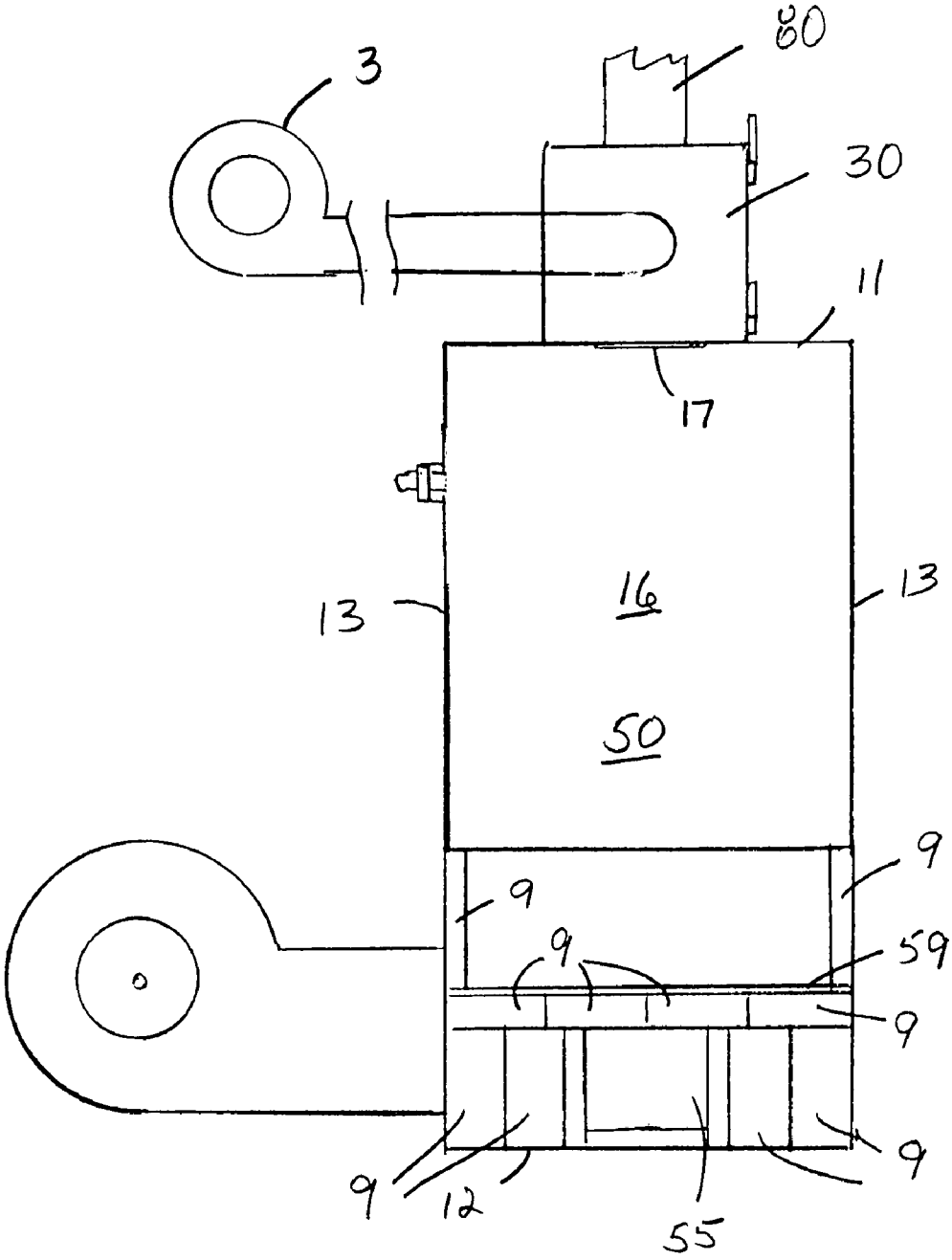
FIG. 3 is a front view, partly in section, of the invention furnace.
Figure 4:
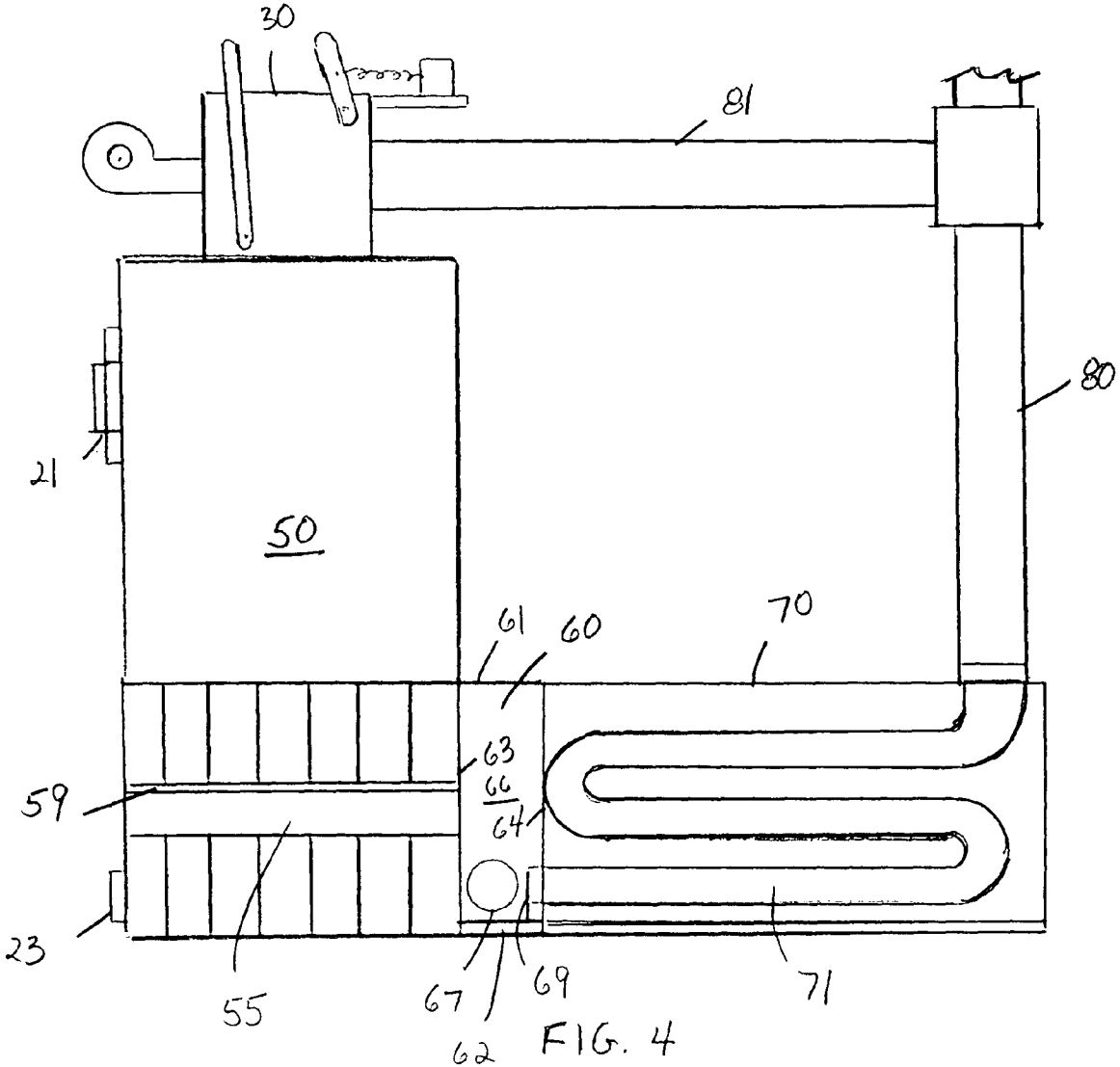
FIG. 4 is a side view, partly in section, thereof.

Referring to the drawings in detail wherein like elements are indicated by like numerals, there is shown a wood burning furnace 1 constructed according to the principles of the present invention. The furnace 1 has a firebox 10 having a top 11, a bottom 12, two opposite sides 13, a front 14, and a rear 15, said top, bottom, sides, front and rear defining a firebox interior 16. The furnace 1 is further comprised of an air box 30 connected to the firebox top 11, a manifold chamber 60 connected to the firebox rear 15 near to the firebox bottom 12. The manifold chamber 60 is attached to a heat exchanger 65 with an outlet to a furnace exhaust flue 80.

The air box 30 has a generally rectangular shape, but other invention embodiments may have different shapes. The air box 30 has a front wall 31, rear wall 32, a left side wall 33, a right side wall 34, a top 35, and a bottom 36, said walls, top and bottom defining a hollow air box interior 37. The air box bottom 36 is attached to the firebox top 11. The air box 30 has a plurality of apertures formed therein. A first aperture 38 is formed in the air box rear wall 32. The first aperture 38 opens into an up draft exhaust pipe 81 terminating into the furnace exhaust flue 80. A second aperture 39 is formed in the air box bottom 36. The firebox body top 11 has a corresponding aperture 17 providing fluid access from the air box interior 37 into the firebox body 10. A third aperture 40 is formed in the air box front wall 31. The third aperture 40 is connected to a combustion air blower 3 and provides access for forced air from the blower 3 into the air box interior 37.

The air box interior 37 has a first damper 41 pivotally connected therein, said first damper operationally adapted to fit over the air box first aperture 38. The first damper 41 is connected to a first lever 42 pivotally attached outside the air box to the air box right side wall 34, near to the air box top 35. The first lever 42 is further attached to a solenoid thermostat 5. The first lever 42 may be manually operated or automatically operated through thermostatic control.

The air box interior 37 has a second damper 43 pivotally connected therein, said second damper operationally adapted to fit over the air box second aperture 39. The second damper 43 is connected to a second lever 44 pivotally attached outside the air box to the air box right side wall 34, near to the air box bottom 36. The second lever 44 is manually operated and may be locked into a desired position.

The firebox interior 16 is vertically divided into an upper segment 50 and a lower segment 55 divided by a horizontal grate assembly 59. The firebox interior upper segment 50 is defined by the firebox top 11 and the grate assembly 59, said upper segment 50 comprising a wood storage compartment and a primary combustion chamber. The firebox body 10 has a first front aperture 20 opening into the firebox interior upper segment 50, said first front aperture 20 sealable by means of a first door 21. The first front aperture 20 provides means for inserting fuel logs 7 into the interior upper segment 50.

The firebox interior lower segment 55 is defined by the grate assembly 59 and the firebox bottom 12, said lower segment 55 comprising a secondary combustion chamber. The firebox body 10 has a second front aperture 22 opening into the firebox interior lower segment 55 sealable by means of a second door 23. The second front aperture 22 provides means for removal of ash 8. The firebox interior lower segment 55 is lined with firebrick 9. The firebox body rear 15 has a rear aperture 24 formed therein near to the firebox bottom 12 opening from the firebox interior lower segment 55 into the manifold chamber 60 which interconnects the secondary combustion chamber with the furnace heat exchanger 70.

The manifold chamber 60 has a top 61, bottom 62, front 63, rear 64, and two opposite sides 65, said top, bottom, front, rear, and sides defining a manifold chamber interior 66. The manifold chamber open front 63 coincides with the secondary combution chamber rear aperture 24. One manifold chamber side 65 has a side aperture 67 sealable by means of a door 68. The manifold chamber side aperture 67 provides access into the manifold chamber interior 66 for removal of residual ash. The manifold chamber rear 64 has a rear aperture 69 providing hot air interconnection with the furnace heat exchanger 70.

The furnace heat exchanger 70 is comprised, in this invention embodiment, of a sepentine pipe arrangement 71 beginning at a low horizontal level and rising to join the exhaust flue 80. A second blower 75 may optionally be arranged on one side of the heat exchanger serpentine pipe arrangement to blow air across the heat exchanger 70 thereby warming a surrounding area.

Primary combustion of the fuel logs 7 take place in the firebox interior upper segment 50 from the fuel log tops to fuel log bottoms adjacent the grate assembly 59. Air from the air combustion air blower 3 through the air box 30, through the air box second aperture 39 into the firebox interior upper segment 50 and down through the wood storage compartment channels combustion of the fuel logs 7 toward the fuel log bottoms 8. Combustible gases flow downward through the grate assembly 59 from the primary combustion chamber 50 into the secondary combustion chamber 55 below the grate assembly 59.

In operation air is forced into the air box 30 by the combustion air blower 3 and downwardly through the second air box aperture 39 into and through the wood storage compartment/primary combustion chamber 50 containing the wood fire with a bed of coals 6 on the grate assembly 59 being fed with fresh fuel from above. The fire releases smoke, particulates, combustibles and other volatile gases through the grate assembly 59 into the secondary combustion chamber 55. The air provided for combustion of the starting fuel material is forced through the hot coals 6 of the burned fuel, pulling vapors 4 and particulates within the air to the secondary combustion chamber 55. Combustion of the particulates, gases and smoke continues within the secondary combustion chamber 55 increasing temperatures to approximately 2000° F. The heated air from secondary combustion passes into the manifold chamber interior 66 and into the heat exchanger serpentine pipe 71. The heated air flows through the pipe 81 and exits to the smoke stack 80. A second air blower 75 may be positioned along side the heat exchanger 70 directing air across the heat exchanger into the surrounding area.

Figure 5A:
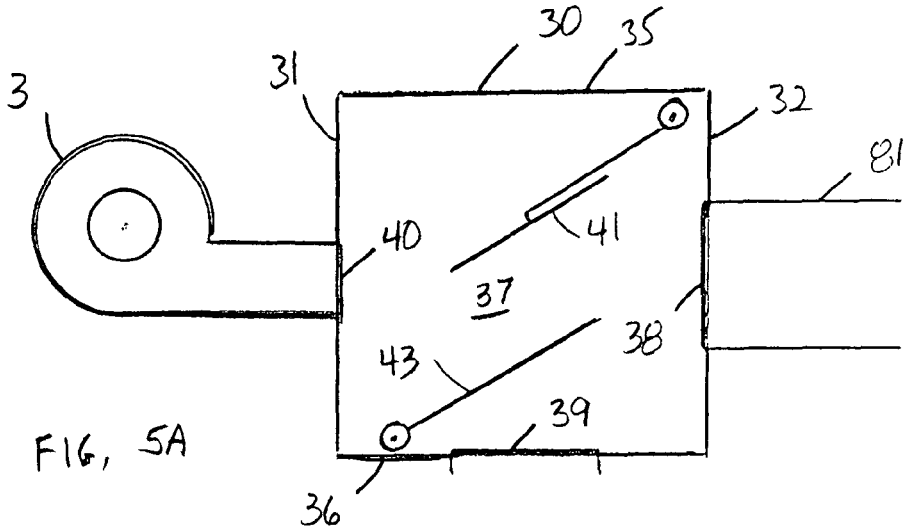
FIG. 5A is a side sectional view of the air box with the blower off.
Figure 5B:
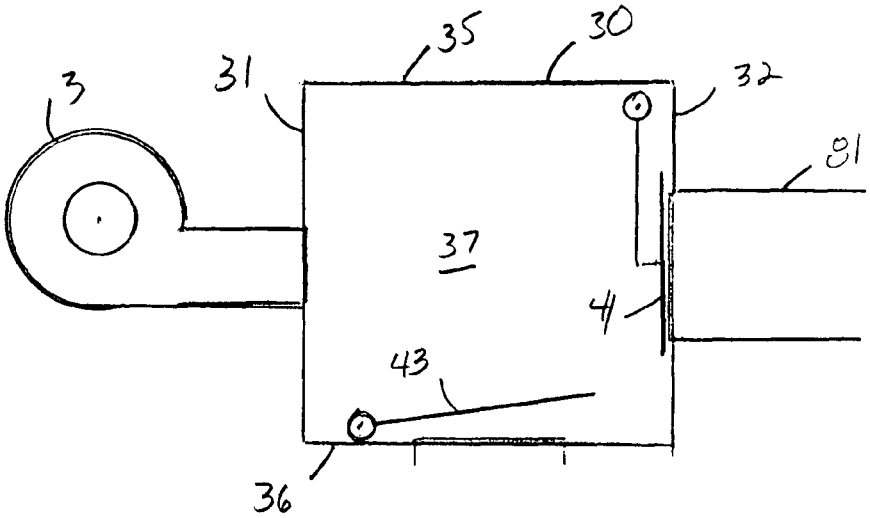
FIG. 5B is a side sectional view of the air box set for a maximum heat.
Figure 5C:
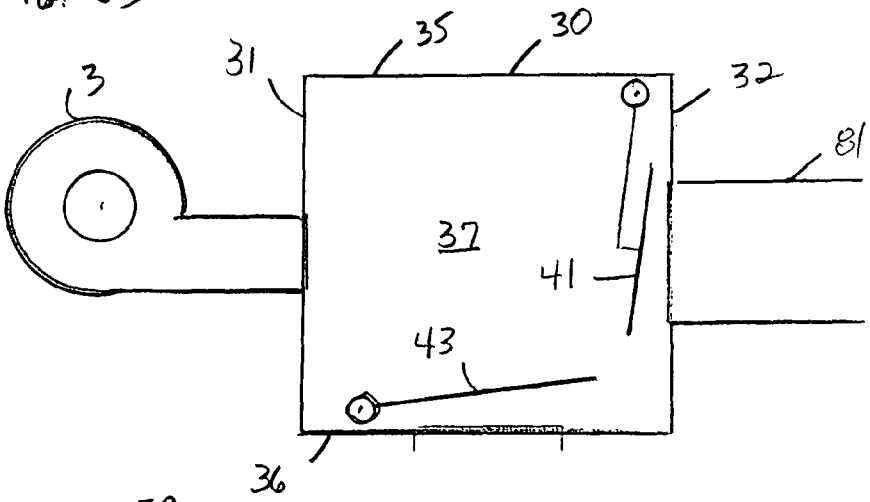
FIG. 5C is a side sectional view of the air box set for minimum heat.
Figure 6:
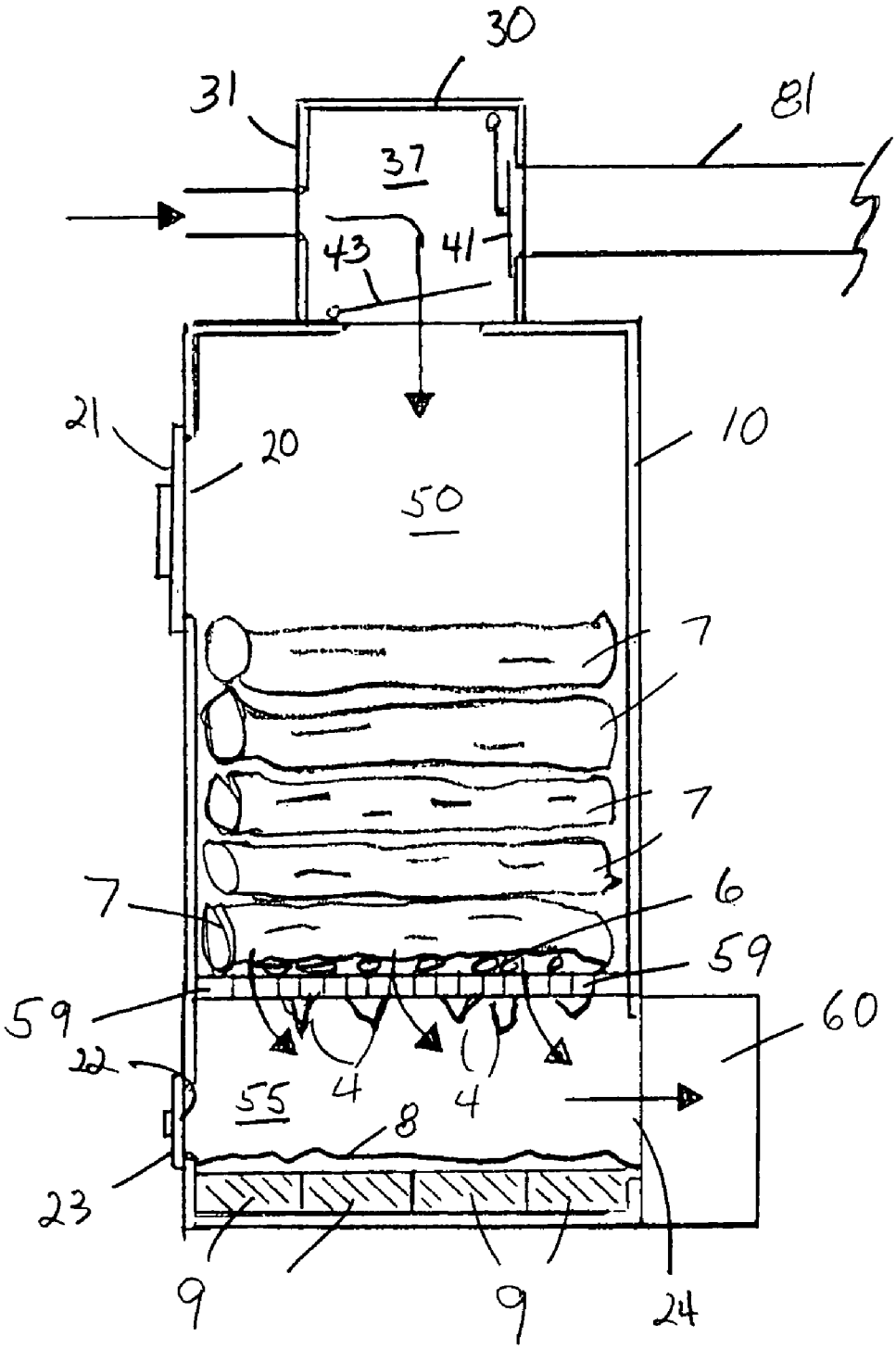
FIG. 6 is a partial side interior view of the furnace.
Figure 7:
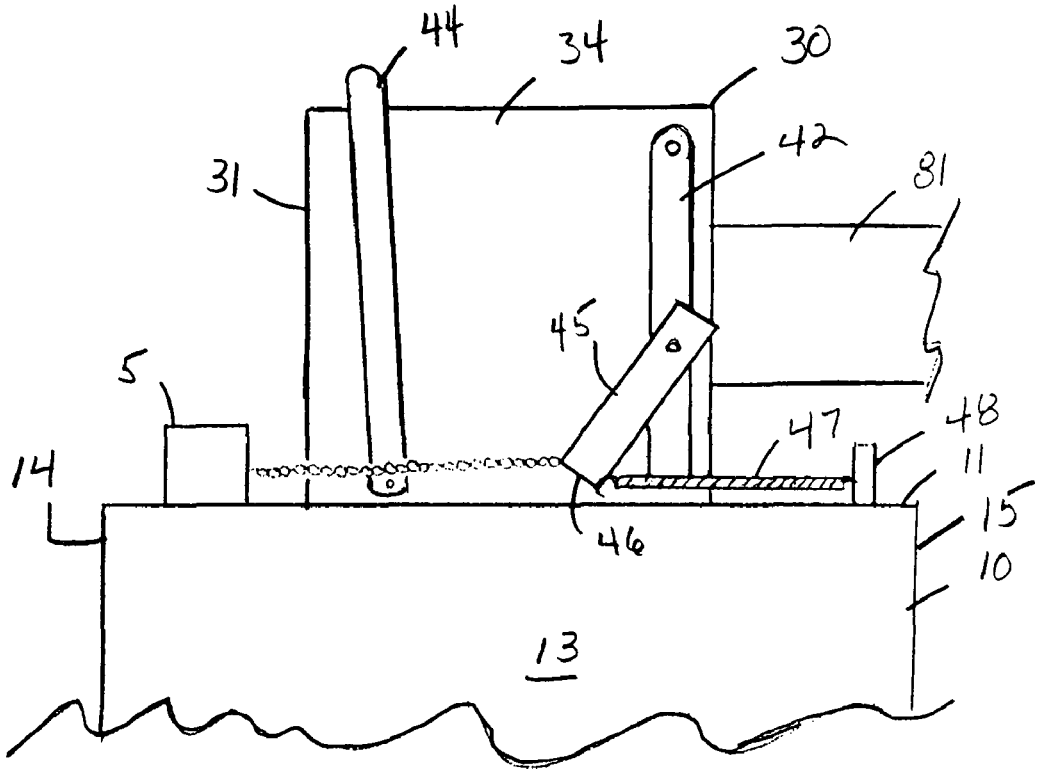
FIG. 7 is a fine adjustment control attached to the first air box lever.

To add wood 7 to the wood storage compartment 50, the combustion air blower 3 is shut off, and the air box first and second dampers 41, 43 are opened. See FIG. 5A. After the desired amount of wood 7 is added, the combustion air blower 3 is turned on, the first damper 41 is closed over the air box first aperture 38, and the second damper 43 is partially closed to a pre-set opening over the second aperture 39. When room temperature rises, the thermostat 5 opens the first damper 41 reducing air pressure in the wood storage compartment/primary combustion chamber 50 and reducing the amount of combustion. See FIG. 5C. When room temperature cools, the thermostat closes the first damper 41, thereby directing more air into the wood storage compartment/primary combustion chamber 50 increasing the amount of combustion. See FIG. 5B. Through manipulation of the blower and air box dampers specific control of the stove is attained.

The present invention is unique from prior art downdraft furnaces in that the present invention dampers are contained in a self-contained air box separated from and positioned above the furnace body. The invention air blower 3 feeds directly into the air box and not the stove body. Thermostat control of the first damper is provided. The air blower may be manually controlled or controlled by means of a thermostat.

It is understood that the above-described embodiment is merely illustrative of the application. Other embodiments may be readily devised by those skilled in the art which will embody the principles of the invention and fall within the spirit and scope thereof. A fine adjustment control may be added to the first lever 42. The fine adjustment control is comprised of an elongated element 45 attached at one end to the first lever 42. The elongated element other downward end 46 is attached to the solenoid thermostat 5. The solenoid thermostat 5 is now attached to the fire box top 11 near to the firebox front 14. A spring means 47 is also attached at one end to the elongated element other downward end 46 and at the other end to a post 48 attached to the firebox top 11 near to the firebox rear 15.

It is understood that the above-described embodiment is merely illustrative of the application. Other embodiments may be readily devised by those skilled in the art which will embody the principles of the invention and fall within the spirit and scope thereof.

I claim:

1. A wood burning furnace, comprising:

a firebox having a top, a bottom, two opposite sides, a front, and a rear, said top, bottom, sides, front and rear defining a firebox interior, said firebox top having an aperture formed therein, said firebox interior being vertically divided into an upper segment and a lower segment separated by a horizontal grate assembly, said interior upper segment comprising a wood storage compartment and primary combustion chamber, and said interior lower segment comprising a secondary combustion chamber;

an air box connected to the firebox top, said air box having a front wall, rear wall, left side wall, a right side wall, a top, and a bottom, said walls, top and bottom defining a hollow air box interior, said air box bottom being attached to the firebox top, said air box having a plurality of apertures formed therein, one of said plurality of apertures being a first aperture formed in the air box rear wall, said first aperture opening into an up draft exhaust pipe terminating into a furnace exhaust flue, another of said plurality of apertures being a second aperture formed in the air box bottom, said second aperture corresponding to the firebox body top aperture providing fluid access from the air box interior into the primary combustion chamber, another of said plurality of apertures being a third aperture formed in the air box front wall, said third aperture being connected to a combustion air blower providing access for forced air from the combustion air blower into the air box interior and subsequently into and through the primary combustion chamber, and into and through the secondary combustion chamber;

wherein said air box interior is further comprised of:

a first damper operationally adapted to fit over the air box first aperture, said first damper being connected to a first lever pivotally attached outside the air box to the air box right side wall, said first lever being attached to a thermostat; and a second damper operationally adapted to fit over the air box second aperture, said second damper being connected to a second lever pivotally attached outside the air box to the air box right side wall;

a manifold chamber connected to a secondary combustion chamber aperture, near to the firebox bottom, opening from the secondary combustion chamber into the manifold chamber which interconnects the secondary combustion chamber with a furnace heat exchanger having an outlet to said furnace exhaust flue, said manifold chamber adapted to receive forced air from said secondary combustion chamber and passing said forced air through said heat exchanger.

2. A wood burning furnace as recited in claim 1, wherein:

the firebox body has a first front aperture opening into the firebox primary combustion chamber, said first front aperture sealable by means of a first door, said first front aperture providing means for inserting fuel logs into the primary combustion chamber.

3. A wood burning furnace as recited in claim 2, wherein:

the firebox body has a second front aperture opening into the firebox secondary combustion chamber sealable by means of a second door, said second front aperture providing means for removal of ash.

4. A wood burning furnace as recited in claim 3, wherein:

the manifold chamber has a top, a bottom, an open front, a rear, and two opposite sides, said top, bottom, front, rear, and sides defining a manifold chamber interior, said manifold chamber open front coinciding with the secondary combustion chamber rear aperture;

wherein one manifold chamber side has a side aperture sealable by means of a door, said manifold chamber side aperture providing access into the manifold chamber interior for removal of residual ash;

wherein the manifold chamber rear has a rear aperture providing hot air interconnection with the furnace heat exchanger.

5. A wood burning furnace as recited in claim 4, wherein:

the heat exchanger is comprised of a sepentine pipe arrangement beginning at a low horizontal level and rising to join the furnace exhaust flue.

6. A wood burning furnace as recited in claim 5, further comprising:

a heat distribution blower positioned on one side of the heat exchanger serpentine pipe arrangement and adapted to blow air across the heat exchanger.

7. A wood burning furnace as recited in claim 6, wherein:

the firebox interior lower segment is lined with firebrick.

* * * * *